US006192646B1

(12) United States Patent
Grewe et al.

(10) Patent No.: US 6,192,646 B1
(45) Date of Patent: Feb. 27, 2001

(54) ROUND CLADDING SYSTEM

(75) Inventors: Ronald E. Grewe, Novi; Brian J. Hillstrom, Milford; Matthew Adams, Novi, all of MI (US)

(73) Assignee: Marketing Displays, Inc., Farmington Hills, MI (US)

( * ) Notice: Subject to any disclaimer, the term of this patent is extended or adjusted under 35 U.S.C. 154(b) by 0 days.

(21) Appl. No.: 09/316,733

(22) Filed: May 21, 1999

Related U.S. Application Data

(63) Continuation-in-part of application No. 09/120,585, filed on Jul. 22, 1998, now Pat. No. 6,009,683, which is a continuation-in-part of application No. 08/926,847, filed on Sep. 10, 1997, now Pat. No. 5,881,528.

(51) Int. Cl.[7] ..... E04C 3/30

(52) U.S. Cl. ..... 52/721.4; 52/721.5; 52/737.4; 52/738.1; 52/736.4; 52/301

(58) Field of Search ..... 52/720.1, 721.1, 52/721.2, 721.3, 721.4, 721.5, 737.1, 736.1, 736.3, 301, 737.4, 738.1, 736.4, 263, 396.04, 302.5

(56) References Cited

U.S. PATENT DOCUMENTS

| | | | | |
|---|---|---|---|---|
| 154,852 | * | 8/1874 | Drake et al. | 52/737.4 |
| 796,227 | * | 8/1905 | Lally | 52/721.4 X |
| 1,643,955 | * | 10/1927 | Rank et al. | 52/736.3 X |
| 2,046,152 | | 6/1936 | Dean . | |
| 2,664,977 | | 1/1954 | Starcevich . | |
| 3,355,852 | * | 12/1967 | Lally | 52/721.4 |
| 3,375,620 | | 4/1968 | Phillips . | |
| 3,760,544 | * | 9/1973 | Hawes et al. | 52/396.04 X |
| 3,998,028 | * | 12/1976 | Pelletier et al. | 52/737.4 |
| 4,009,550 | | 3/1977 | Young . | |
| 4,034,535 | | 7/1977 | Dustmann . | |
| 4,040,223 | | 8/1977 | Hillstrom . | |
| 4,467,584 | * | 8/1984 | Crites et al. | 52/737.4 |
| 4,606,167 | | 8/1986 | Thorne . | |
| 4,696,136 | | 9/1987 | Grewe . | |
| 4,823,533 | | 4/1989 | Hillstrom . | |
| 4,854,107 | * | 8/1989 | Roberts | 52/721.4 |
| 5,150,554 | | 9/1992 | Quinlan, Jr. . | |
| 5,335,471 | | 8/1994 | Kupiec . | |
| 5,881,528 | | 3/1999 | Grewe . | |

FOREIGN PATENT DOCUMENTS

| | | |
|---|---|---|
| 361699 | 12/1938 | (IT) . |
| 5-44300 | 8/1991 | (JP) . |
| 4-30067 | 2/1992 | (JP) . |

* cited by examiner

*Primary Examiner*—Beth A. Stephan
*Assistant Examiner*—Brian E. Glessner

(57) ABSTRACT

System for covering or cladding poles, columns and utility structures. Pairs of vertically-oriented frame members are attached to a column or pole by a supporting bracket mechanism, or directly on a utility structure, such as a gasoline pump. Semi-circular panel members are positioned between adjacent frame members and/or around a pole or column. With column and pole cladding systems, top cap members can be provided adjacent canopy or ceiling structures to allow for thermal expansion and contraction. The panel members are shipped and packaged in flat condition and bent into their final semi-circular shapes at the installation site. Retainer clip members, tab members or pin members are attached to the edges of the panel members in order to hold them securely in place in the frame members. Trim cap members can be provided to cover the frame members and secure the edges of the panels securely in place in the frame member. A universal supporting bracket system can be utilized to attach the cladding system to various poles or columns.

20 Claims, 8 Drawing Sheets

ROUND CLADDING SYSTEM

CROSS-REFERENCE TO RELATED APPLICATION

This is a continuation-in-part of U.S. patent application Ser. No. 09/120,585, filed on Jul. 22, 1998, and entitled "Improved Round Column Cladding System", now U.S. Pat. No. 6,009,683, which in turn is a continuation-in-part of U.S. patent application Ser. No. 08/926,847 filed on Sep. 10, 1997 and entitled Round Column Cladding System, now U.S. Pat. No. 5,881,528.

TECHNICAL FIELD

The present invention relates to a system for covering columns and poles with a cladding, as well as providing curved cladding end members for stationery objects, such as fuel pumps and the like.

BACKGROUND ART

Numerous buildings and places of businesses today have columns and poles which are used to support canopies and other overhead structures and also typically have permanent ground structures and other utility members exposed to the public. The columns or poles are typically made of posts, box-beam or I-beam construction and typically are not aesthetically pleasing. Similarly, fuel pumps and other utility structural members which are exposed to the public at service stations and other businesses are typically unpleasing in structure and/or appearance.

Various systems are known for covering poles and columns with various types of cladding or facings, or for forming semi-circular decorative facing structures. Examples of these are shown, for example, in U.S. Pat. Nos. 4,823,533 and 4,696,136. Some known systems have panels pre-formed in their final sizes and shapes. Also, a panel framing system is shown in U.S. Pat. No. 4,040,223. Similarly, there are known systems for improving the appearance of gasoline pumps and other utility structures.

Known systems often are expensive and/or difficult to manufacture, transport and assemble. The panel members used with such systems often require extensive forming and shaping procedures. Also, some systems utilize a large number of different parts with different sizes and shapes causing difficulty in assembly and installation. Known systems with preformed panels are usually difficult and expensive to package and ship to installation sites. Typically, larger and more expensive carton and crating materials are required, thus also causing high freight costs. Further, known systems are often not sufficiently sturdy or durable for their expected purpose and are difficult to replace or change if it becomes necessary to do so.

SUMMARY OF THE INVENTION

It is an object of the present invention to provide an improved covering or cladding for poles, columns and utility structures, such as fuel (gasoline) pumps. It is also an object of the present invention to provide a low-cost system for covering or highlighting such items which also can be easily assembled.

It is a further object of the present invention to provide cladding systems which have a minimum of parts and are easy to install and replace where necessary. It is a still further object of the present invention to provide systems which have mostly flat and/or non-preformed components in order to minimize packaging and freight expenses.

It is another object of the invention, with respect to columns and posts, to provide a column cladding system which is tightly sealed at its ends and can compensate for thermal expansion and contraction during use.

These and other objects and purposes of the present invention are secured by the present invention. The present invention is an improvement over known systems for covering poles and column, and for enhancing the appearance of utility structures, and provides low-cost, easily assembled systems.

The present invention includes a structural system, such as supporting brackets, which are attached to the pole, column or utility structure. For a column or pole, elongated vertical frame members are provided on two sides of the pole or column, substantially 180° apart. For utility structures, elongated frame members are provided along the corners or the ends of the structures. The frame members have elongated channels and are secured to a support mechanism, which, in turn, is attached or secured to a pole or column or attached to the utility structure itself. Flexible panel members formed into half-circles are positioned between pairs of vertically-oriented elongated frame members. The formed panels create rigid panels which maintain a curved shape with a true radius.

A plurality of retainer clips or posts can be positioned on the edges of the panel members in order to retain the panel members in the channels in the frame members. Retaining clips can be secured to the edges of the panels by barbs or tangs. Protruding spring tabs or members can be utilized to hold the clips in place in the channels. The posts can be inserted through openings in the panel members.

Vertically joined panel members are secured together by splice members positioned inside the curved cladding members. The splice members hold adjacent panel members together and are secured in place, preferably by an adhesive or double-sided tape.

In alternate embodiments, edge trim members can be provided which mate with the vertical frame members and cover the vertical frame members. The trim members can also help hold the panels in place and can add to the aesthetics of the cladding system. In still another embodiment, the panel members are riveted or otherwise securely affixed to the vertical frame members by fasteners and an edge trim member is provided covering the fasteners from view.

Alternate support mechanisms can be used to secure the frame members to a pole or column. A "universal"-type supporting mechanism can be provided which can accommodate poles and columns of various sizes and cross-sectional shapes.

Other alternative systems use raised edges or tab members along the edges of the panel member instead of retainer clips, or pins or rivets positioned adjacent the panel edges. The latter system is particularly useful in high wind situations.

In order to provide a tight seam or seal along the upper edge of the cladding system under all environmental conditions, top cap members are provided which allow for thermal expansion and contraction of the cladding system during use. The top cap members are positioned between the uppermost panel member and the canopy or ceiling structure and have slots which allow for movement of the cap members relative to the panel members.

Other features and benefits of the present invention will become apparent from the following description of the invention, when viewed in accordance with the attached drawings and appended claims.

BEST MODES FOR CARRYING OUT THE INVENTION

Figure 1:
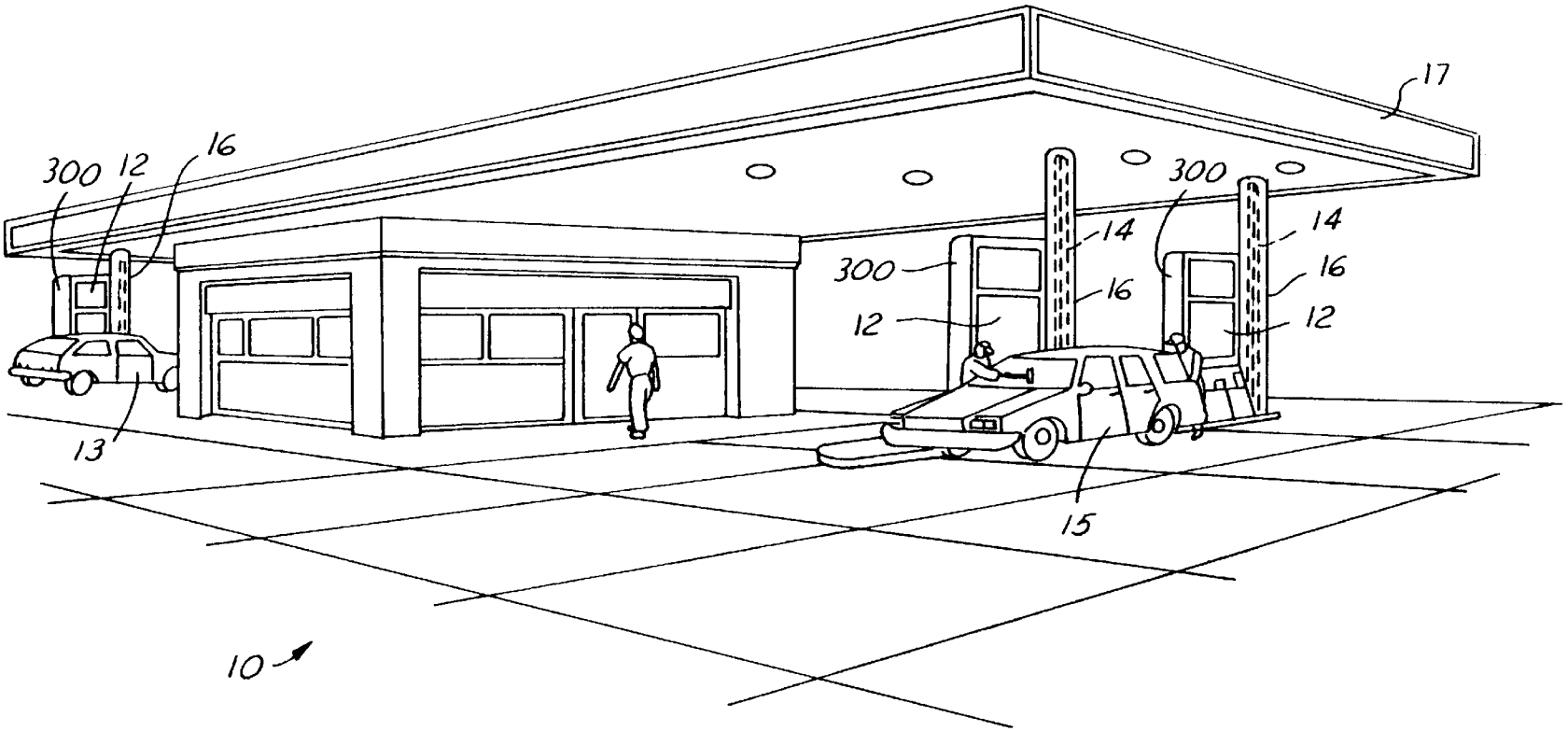
FIG. 1 illustrates a place of business having poles and/or columns, as well as structural gasoline (fuel) pumping members.

Preferred embodiments of the present invention are shown in FIGS. 1–19. The embodiments provide unique cladding or covering systems for poles, columns, and utility structures, such as gasoline pumps. The present invention has particular usage at gasoline service stations, such as the one shown in FIG. 1 and referred to generally by the reference numeral 10.

The present invention has particular use in covering poles, columns, and the like, and in enhancing the appearance of fuel (gasoline) pumping devices at places of business, such as service station 10. The poles or columns 14 support a canopy or roof structure 17 at the business. The present invention in part provides a cladding or covering system 16 which is positioned around the poles, columns, and the like in order to protect and hide them from view.

Figure 16:
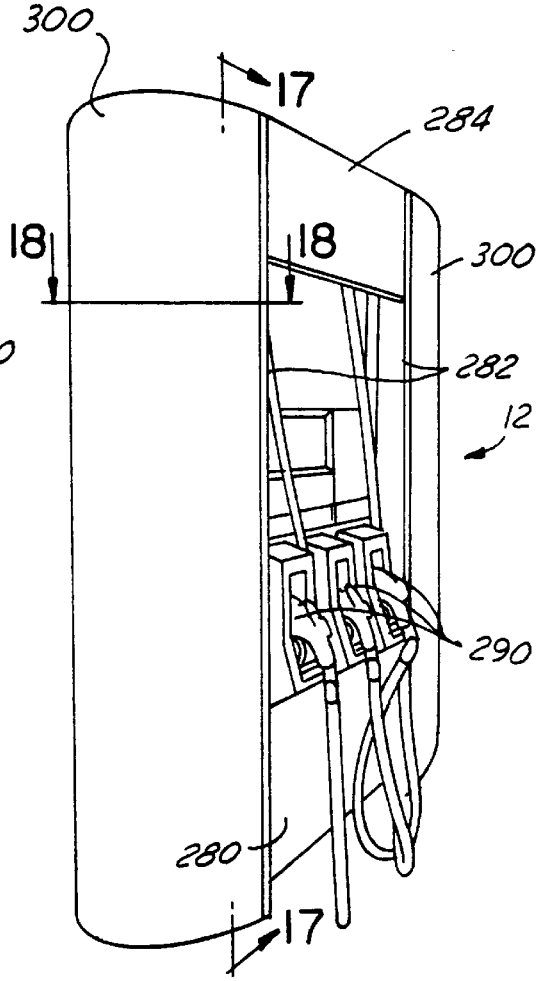
FIGS. 16–19 illustrate the use of the present invention on a gasoline pump, with FIG. 16 being a perspective view, FIGS. 17 and 18 being cross-sectional views taken along lines 17—17 and 18—18, respectively in FIG. 16, and FIG. 19 being an enlarged view depicting one manner in which the panel members are attached to the gasoline pump.

The service station 10 also has a plurality of gasoline or fuel pumping devices ("pumps" ) 12 which allow drivers to refill the fuel tanks of their vehicles, such as cars 13 and 15. There are numerous sizes, styles and types of pumps at service stations throughout the U.S. and worldwide, one of which is depicted in FIG. 16 and discussed in more detail below. The present invention in part also provides a curved cladding or covering member 300, which is positioned on the sides or ends of the pumps 12.

The column or pole cladding system 16 in accordance with the present invention comprises a plurality of circular cladding members 18 which are positioned around each of the poles or columns 14. Each of the cladding members 18 comprises a pair of semi-circular panel members 20 which are positioned around the pole or column 14 and attached to a support system, as shown in the drawings.

Figure 2:
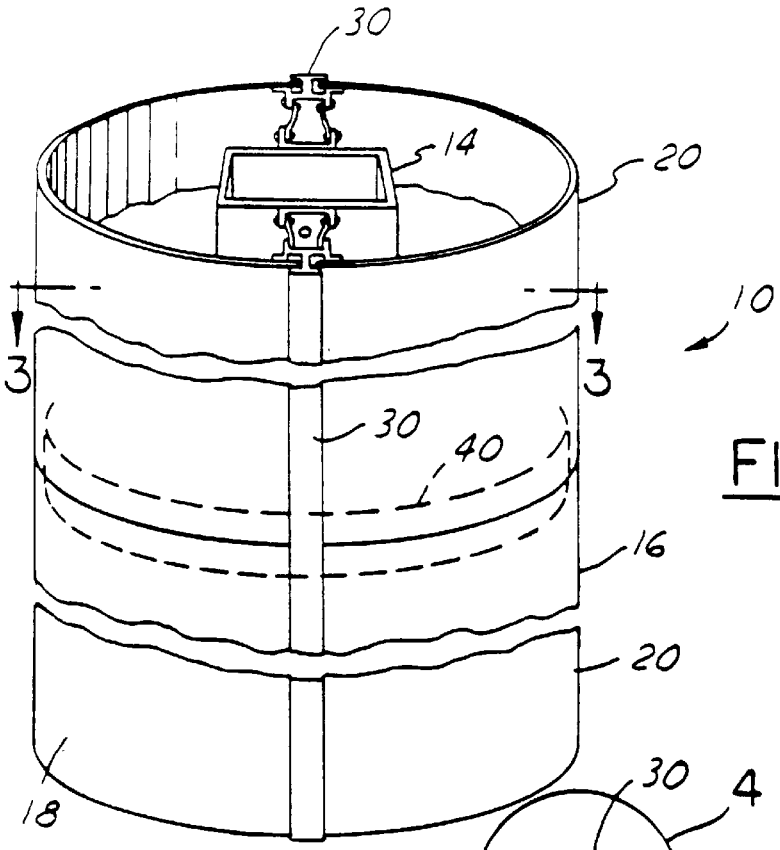
FIG. 2 illustrates use of the present invention on a pole or column.
Figure 3:
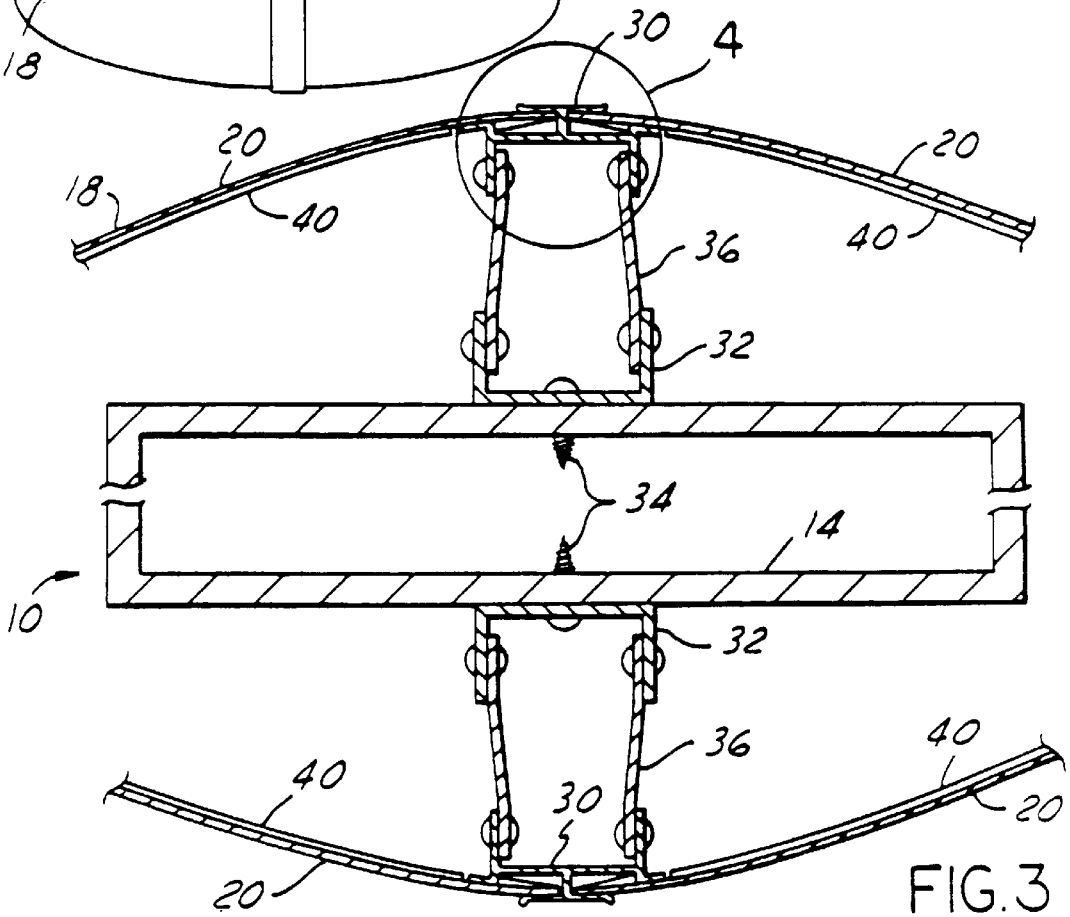
FIG. 3 is a cross-sectional view of the subject matter of FIG. 2, with the cross-section being taken along the line 3—3 in FIG. 2 and in the direction of the arrows.

In this regard, the pole, column, or the like can be of any conventional type, such as a cylindrical post, a metal box-beam column (as shown in FIGS. 2 and 3), an I-beam, or other structural member typically in use today. Also, the poles, columns, or the like can have any cross-sectional size and shape. Preferably, however, the present invention is used with columns 14–28 inches in diameter, and specifically about 18 inches in diameter. In order to secure or attach the present invention to a post or column, the system shown in FIG. 3 is preferred for box-type columns and I-beam columns, while the system shown in FIG. 8 has more universal applicability and can be used with posts or columns of virtually any cross-section, including round and non-uniformly shaped.

The panel members 20 used in accordance with the present invention are preferably made from a plastic material, such as high impact ABS material. Also, the panel members 20 preferably have a coating or layer on them which provides UV protection and a high gloss finish. One preferred panel system utilizes materials made by a co-extrusion process with the panel members being formed from a high impact ABS with a thin clear high gloss acrylic layer on them. The pigmentation is included in the ABS material and provides the desired coloration for the cladding system. Alternatively, the outer surfaces can have a textured, satin or matte finish, or any other desired finish.

Two panel members are attached in a circular configuration around the circumference of the pole or column 14 by a pair of elongated frame members 30. The members 30 are preferably made from an extruded aluminum material and are provided in sufficient lengths to cover the entire height of the post or column.

A pair of vertically oriented frame members 30 are positioned 180° apart on opposite sides of the post or column. This is shown in FIGS. 2 and 3. In a preferred embodiment, the frame members 30 are secured to U-shaped bracket members 32 which are fixedly attached to the pole or column 14. The bracket members 32 are attached to the post or column members 14 in any conventional manner, such as by conventional fasteners 34 (as shown in FIG. 3). If necessary, extender members 36 can be utilized to connect the U-shaped bracket members 32 to the extrusion members 30 if the pole or column 14 is relatively small in size and/or diameter, or the column cladding system 16 is sufficiently larger in size and/or diameter.

The vertical frame members should have sufficient rigidity and strength to securely hold the panel members in place. Preferably, the frame members are provided with sufficient strength to allow mounting of various service station accessories on them, such as windshield washing stations, sign brackets, and the like. In this regard, a representative bracket or mounting member for this purpose is shown in phantom lines in FIG. 7 and designated by the reference numeral 35.

Since posts or columns for buildings are typically 10–20 feet in height, and the panel members 20 are typically only about 5–6 feet in height, it is necessary to splice together several cladding members 18 along the height of the post or column 14. In order to splice adjacent column cladding members 18 together, joint or splice back-up panel members 40 are positioned inside each of the seams or joints. These joint panel members 40 are secured to the inside surfaces of the panel members 20 by double-sided tape, gluing, or the like. The joint back-up panel members 40 prevent light from being visible through the joints or cracks between adjacent panels and also retain the cladding members 18 tightly together.

Figure 4:
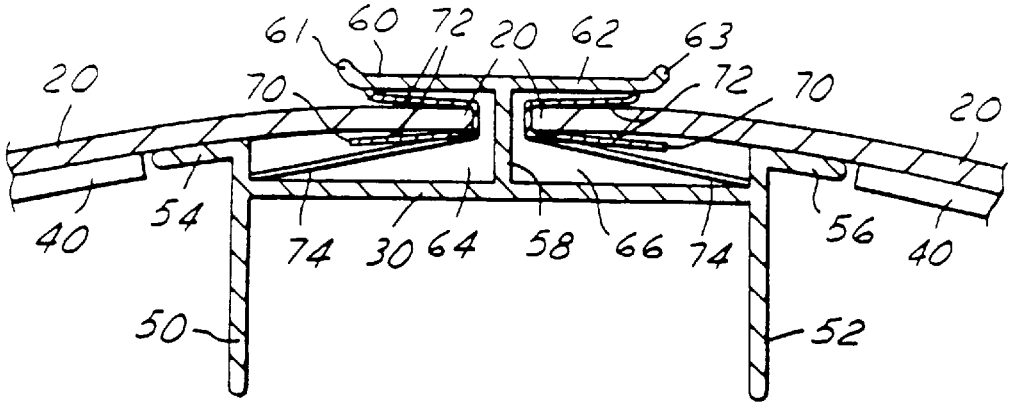
FIG. 4 is an enlarged view of the vertical frame member showing adjacent panels being secured in place in accordance with the present invention.
Figure 5:
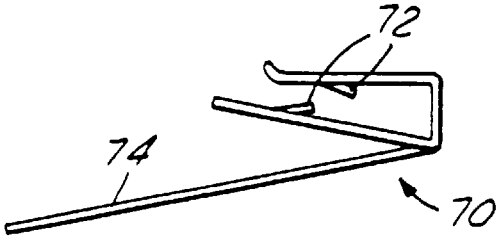
FIGS. 5 and 6 are plan and perspective views, respectively, of a retainer clip for use with the present invention.
Figure 6:
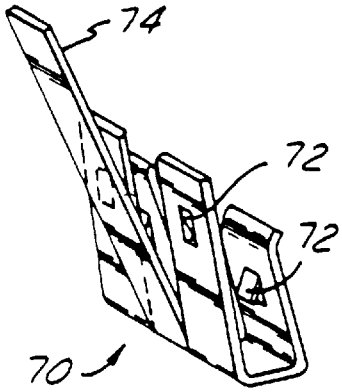

As particularly shown in FIG. 4, the frame members 30 each have a pair of leg members 50 and 52 which are used for attaching the extrusion members 30 to the pole or column, as well as a pair of flange members 54 and 56 which are used to support the panel members 20 adjacent their outer edges. The frame members 30 also have a T-shaped central member 58 with a pair of outwardly extending flanges 60 and 62 which are used to cover and help secure the edges 20' of the panel members 20. The flanges 60 and 62 of the T-shaped member 58 form two elongated channels 64 and 66 in the frame member 30. The edges 20' of the panel member 20 are positioned in the channels 64 and 66 along with the retaining clip members 70, as discussed below.

A plurality of U-shaped retaining clip members 70 are secured to the edges 20' of each of the panel members 20 and are used to fixedly secure the panel members in the frame members 30. The clip members 70 are preferably of the size and shape shown in FIGS. 4–6, although it is understood that other conventional retaining clip members could be utilized so long as they perform and fulfill substantially the same objects and purposes of the retaining clip member 70 shown and discussed herein. The clip members 70 are preferably about 0.50 inches in width and have a plurality of barbs or tangs 72 which are used to hold the clip members tightly on the edges of the panel members 20. The clip members 70 also contain an elongated spring or tab member 74 which is sized to fit within the channels 64 and 66 of the frame members in order to hold the panel members securely in place therein.

As shown in FIG. 4, once the retaining clip members 70 are positioned on the edges of the panel members 20, the panel members 20 can be inserted into the chambers 64 and 66 in the frame members 30 and thereby held tightly and securely in place around the pole or column. Similarly, if a panel member 20 is damaged or needs to be replaced for some reason, the panel member 20 can be relatively easily removed from the frame member 30 and a substitute panel member be positioned in its place.

The clip members 70 are positioned approximately every 18–24 inches along the edges 20' of the panel members 20 and the barbs or tangs 72 are angled in order to dig into the panel material and prevent their removal. The spring tab or finger member 74 extends from the clip member at an angle in order to securely wedge itself in position in the channel. One or more members 74 can be provided on each retainer clip member as desired.

Edges 61 and 63 of flange members 60 and 62 are turned up slightly in order to provide lead-ins for the panel members 20. The turned up edges 61 and 63 allow the edges 20' of the panel members 20 with the retainer clips 70 attached thereto to be inserted more easily into channels 64 and 66 in the frame members 30.

The size and shape of the retainer clip members 70 relative to the flanges 60 and 62 and the channels 64 and 66 in the frame member 30 are such that the retaining clip members 70 are hidden from view behind the flanges 60 and 62. In this manner, a secure cladding system for poles and columns is provided which also presents an attractive and aesthetic appearance.

As indicated earlier, the frame members 30 are preferably made from an extruded aluminum material, although other materials of similar durability and strength could be utilized. The panel members 20 are preferably on the order of 0.080 to 0.100 inches in thickness.

Figure 7:
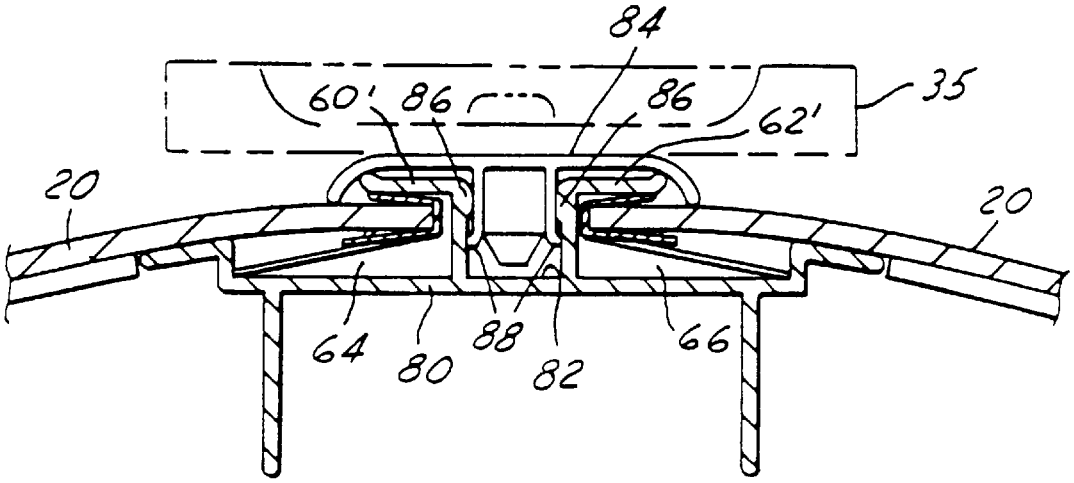
FIG. 7 illustrates an alternate embodiment of the present invention.

FIG. 7 shows an alternative embodiment of the invention. In this embodiment, the frame member 80 has an elongated slot or channel 82 positioned between the channels 64 and 66. In addition, a trim cap member 84 is provided and tightly snapped into the channel 82 as shown. In this regard, in order to securely hold the trim cap member 84 in place, mating ridge members 86 and 88 are provided on the frame member and cap member, respectively.

With the embodiment shown in FIG. 7, the cap member 84 can be made from the same material as the panel members 20, thus providing a continuous cladding system of the same material entirely around the circumference of the pole or column being covered. The outer edges of the trim cap member can also be used to abut the panel members 20, assist in holding them securely in place, and minimize spaces between the flanges 60' and 62' and the outer surface of the panel members.

Figure 8:
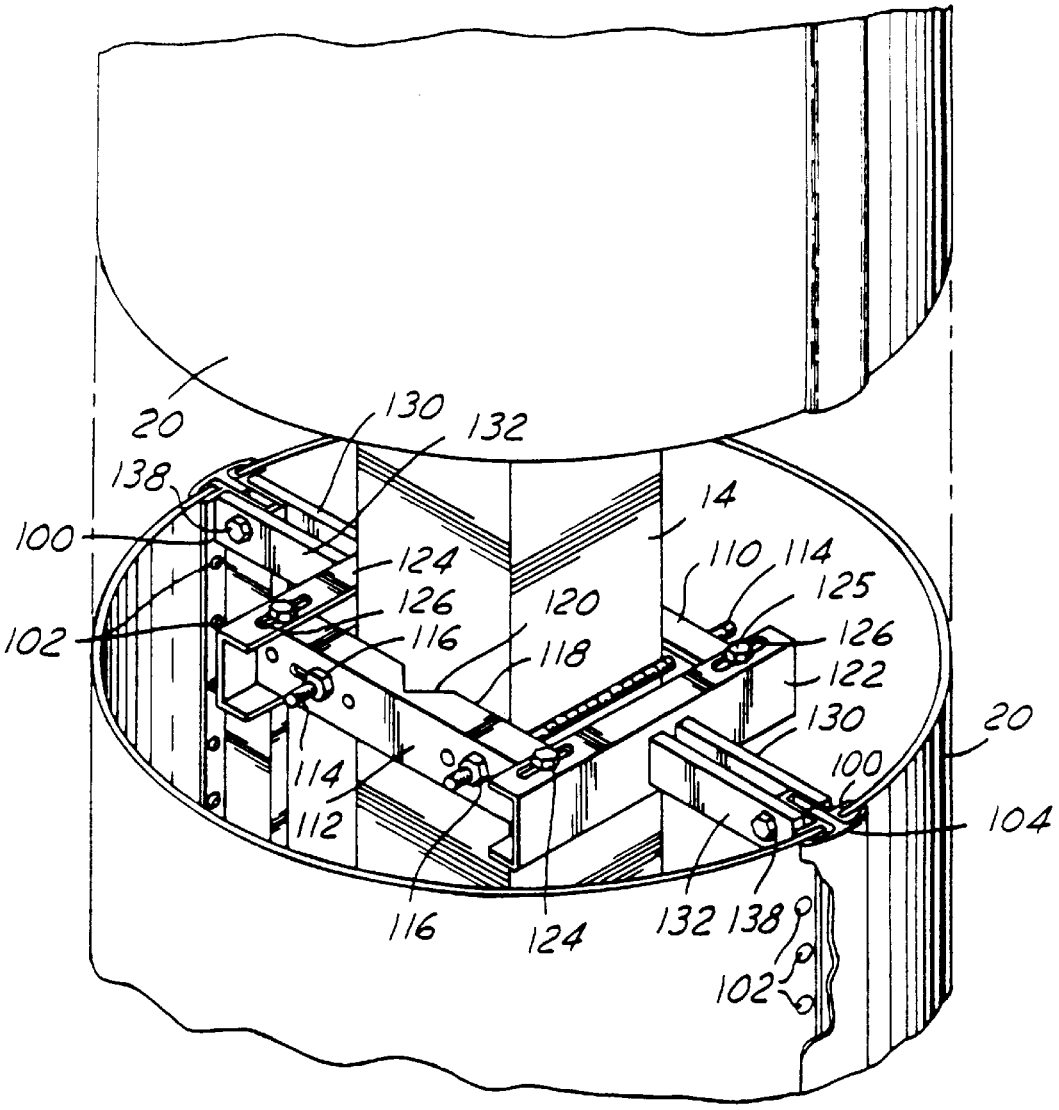
FIG. 8 illustrates still another alternate embodiment of the present invention.

FIG. 8 shows still another embodiment of the present invention. In this embodiment, the frame members are essentially U-shaped channel members 100 and are secured to the edges of the panel members 20 by a plurality of small rivets 102 or other conventional fasteners. A trim cap member 104 is positioned in the frame member 100 in order to cover the fasteners 102 and hide them from view.

The supporting bracket system used with the embodiment shown in FIG. 8 is "universal" and thus adaptable for covering all sizes, types, and cross-sectional shapes of poles and/or columns. A pair of U-shaped bracket members 110 and 112 are held tightly together by threaded fasteners 114. The threaded fasteners 114 are secured to the bracket members 110 and 112 by a plurality of nuts or fastening members 116. The bracket members 110 and 112 have straight edges 118 for accommodating certain sizes and shapes of poles or columns, as well as notches 120 for accommodating corners of pole members or round poles or columns.

An additional pair of U-shaped brackets 122 and 124 are attached to the ends of bracket members 110 and 112 forming a box-like configuration around the pole or column 14. The bracket members 122 and 124 are secured to the bracket members 110 and 112 by a plurality of bolts or other fasteners 124. The bolts or fasteners 124 are positioned in slotted openings 126 in the bracket members 122 and 124 in order to accommodate tightening and loosening of the bracket members 110 and 112 where necessary.

A pair of projecting support members 130 and 132 are attached to each of the support brackets 122 and 124. The support members 130 and 132 in turn are secured to the U-shaped frame members 100 in any conventional manner, such as by bolts or fasteners 138.

With the supporting and mounting system shown in FIG. 8, a wide variety of cross-sectional sizes and shapes of poles and columns 14 can be accommodated with the cladding system.

Figure 9:
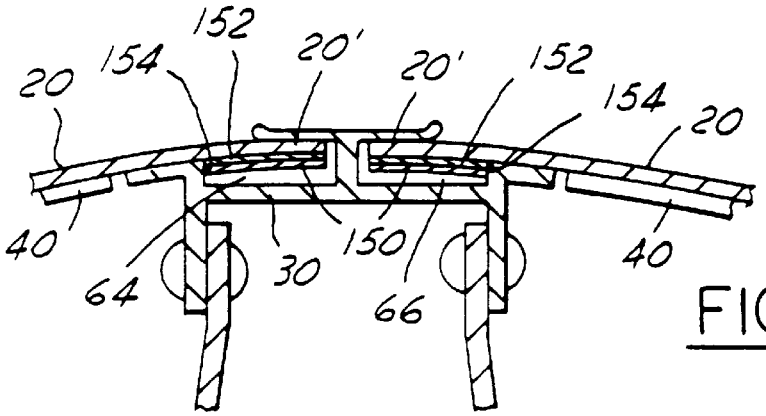
FIG. 9 illustrates a further alternate embodiment of the present invention.

A further embodiment of the invention is shown in FIG. 9. In this embodiment, the retaining clips are replaced with elongated edge or tab members 150. The tab members 150 are positioned along the edges 20' of the panel members 20 and secured in place by double-sided tape 152 or any other comparable means, such as glue, heat bonding, or the like. One of the edges or corners 154 of the tab members 150 is adapted to contact and mate with a wall or surface of the channels 64 and 66 in order to hold the panel members 20 securely in place in the frame members 30. The tab members 150 on each of the panel members can be one single elongated member positioned the full length of the edge of each panel members, or the tab members 150 can be comprised of a plurality of shorter tab members aligned along the edges.

FIGS. 10–13 illustrate an alternate embodiment of the invention which allows tight sealing and securing to canopy members while at the same time allowing the column cladding to compensate for thermal expansion and contraction. In this embodiment, a pair of top cap members 180 are utilized to join together a column cladding system to the underside surface or ceiling 182 of a canopy member 184.

Figure 10:
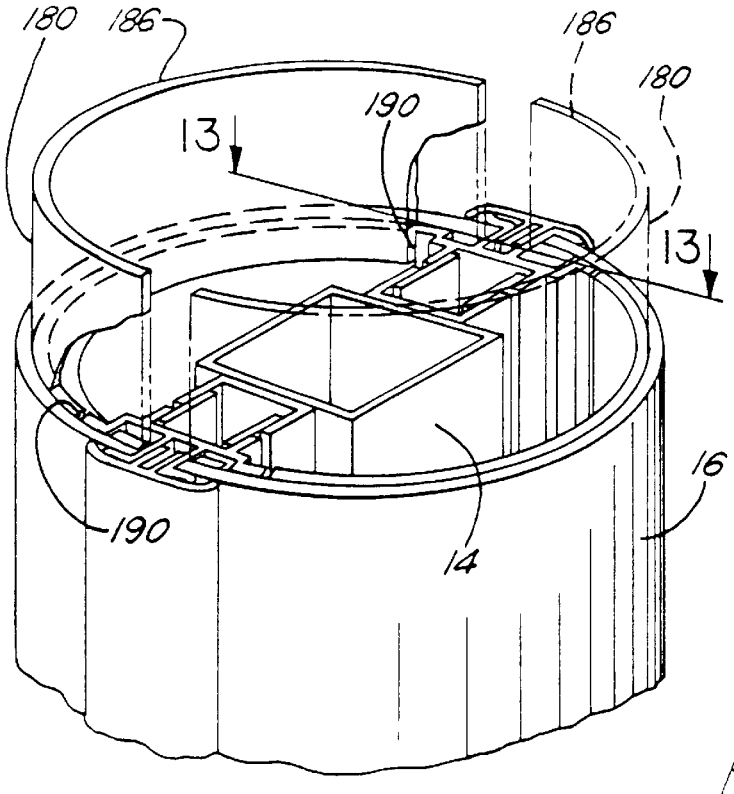
FIGS. 10–13 illustrate an embodiment of the invention with top cap members which compensate for thermal expansion and contraction of the system.
Figure 12:
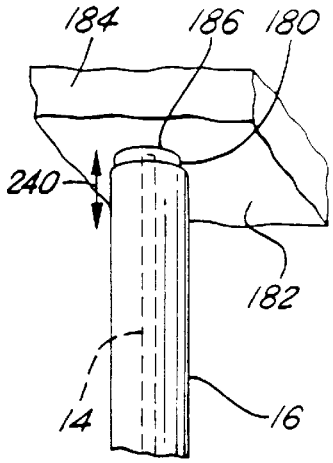

As shown in FIG. 12, the cladding panel system 16 covers a column or post member 14 which is used to support the canopy member 184 on the service station or other place of business. The top cap members 180 allow a tight and secure joint or connection between the cladding panel system 16 and the ceiling 182. In this regard, the top cap members 180 are formed into semi-circular shapes (as shown in FIG. 10) and a pair are provided at the top of each cladding panel system 16.

Each of the top cap members is sealed along its upper edge 186 to the ceiling 182 by any common means, such as a silicone material, an adhesive, or the like. As explained below, the top cap members 180 are attached to the cladding panel system 16 itself in a loose sliding manner such that the entire cladding panel system for the service station or business establishment can compensate for thermal expansion and contraction within the cladding system and without affecting the seal along the edge 186.

Figure 11:
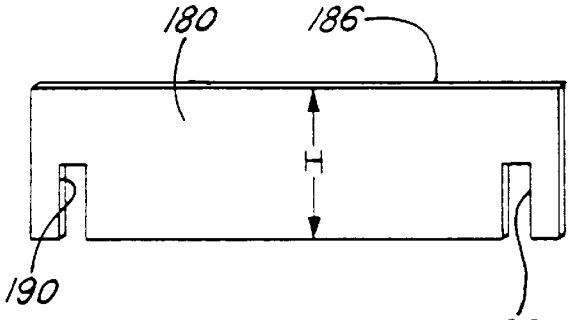
Figure 13:
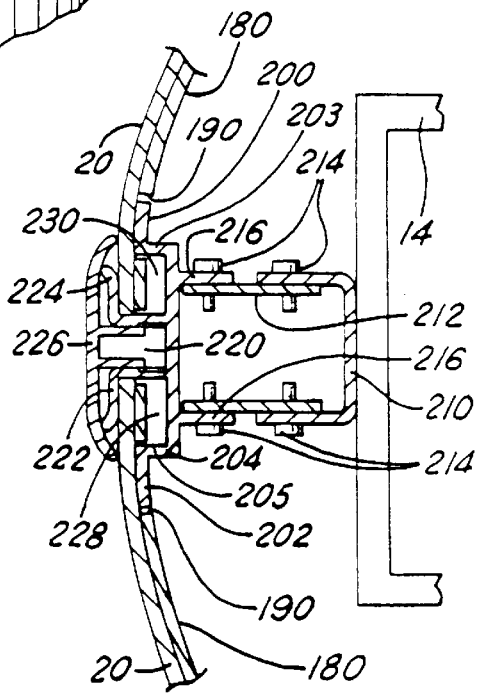

As shown in FIG. 11, each of the top cap members 180 initially comprises a flat rectangular piece of material, preferably the same material which is used to make the cladding panel members 20 described above. Each of the top cap members 180 have a pair of slots (or notches) 190. The slots preferably extend approximately one-half the height H of each of the members, although the height can be any desirable height which performs satisfactorily in accordance with the intended application. When the top cap members 180 are installed, the slots 190 fit over the upper ends of the vertical frame extrusion members 204. As shown in FIG. 13, which is a cross-sectional view taken along line 13—13 in FIG. 10, the slots 190 can be positioned over the width of the flanges 200 and 202, with portions positioned in channels 228 and 230. Alternatively, the top cap members can be positioned such that the slots 190 are positioned over wall portions 203 and 205 of the extrusion members 204, or over the extension members 216 and extension bracket 212.

As shown in FIG. 13, a U-shaped bracket 210 is used to connect the column cladding system to a post or column 14. The vertical frame member 204 can be attached directly to the U-shaped bracket 210 or, as shown in FIG. 13, attached to a bracket extension member 212 which in turn is attached to the U-shaped bracket member 210. In this regard, self-tapping screws or other fasteners 214 are used to attach the frame members, extension members and U-shaped bracket members together.

The vertical frame extrusion member 204 has a pair of extension members 216 which are used to connect the frame member 204 to either the extension bracket member 212, or to the U-shaped bracket member 210. The vertical frame extrusion member 204 has a central channel 220 positioned between a pair of flanged extension members 222 and 224. A trim cap member 226 is secured within the channel 220 in the manner shown in FIG. 13 and as described above with reference to other Figures.

When the column cladding system is installed around the post or column 14, the panel members 20 are positioned in channels 228 and 230 formed in the vertical frame extrusion member 204. The panel members 20 can be secured in the two channels 228 and 230 in any of the manners described above, such as through the use of retaining clip members 70 (not shown).

The top cap members 180 are positioned adjacent to panel members 20 and vertical frame member 204 in the manner discussed above, namely with the slots or notches 190 being positioned over portions of the vertical frame members 204. The top cap members are not hard fastened to the panel members 20 or frame member 204 with any screws, fasteners or the like. Instead, the top cap members essentially float relative to the rest of the column cladding system. Since the top cap members 180 are not fastened or secured to the panel members or vertical frame members in any manner except through the notches or slots, the top cap members are allowed to slide vertically relative to the panel members 20 as shown by arrow 240 in FIG. 12. Since the top cap members are typically sealed tightly to the ceiling 182, they do not move or slide. Instead, the slots 190 allow the panel members 20 and column cladding system 16 to expand and contract relative to the cap members.

When the column cladding system is installed, preferably the vertical frame extrusion members 204 are cut or trimmed, preferably such that they end three or four inches below the ceiling 182. The uppermost panel members 20 on the cladding system are also cut or trimmed such that they end preferably approximately one-two inches below the ceiling 182. The top cap members are then formed into their semi-circular shapes and snapped or slid into place over the extrusion members 204 and sealed tightly to the ceiling. In this manner, the cladding panel members 20 are positioned on the exterior of the top cap members 180 and allowed thermal expansion and contraction without displaying any gaps.

Figure 14:
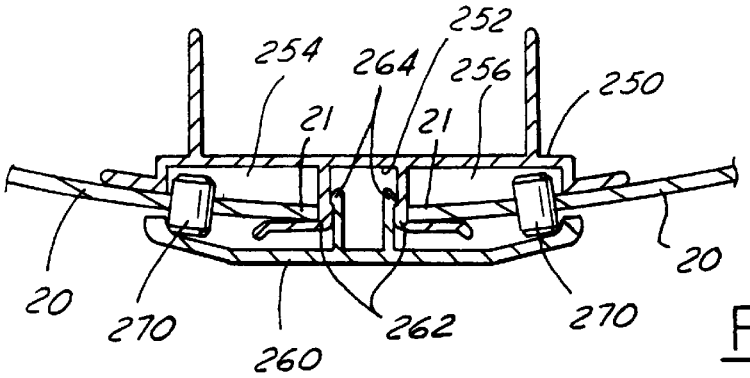
FIGS. 14 and 15 illustrate an alternate embodiment of the invention which utilizes dowel pins to assist in securing the panel members in the frame members.
Figure 15:
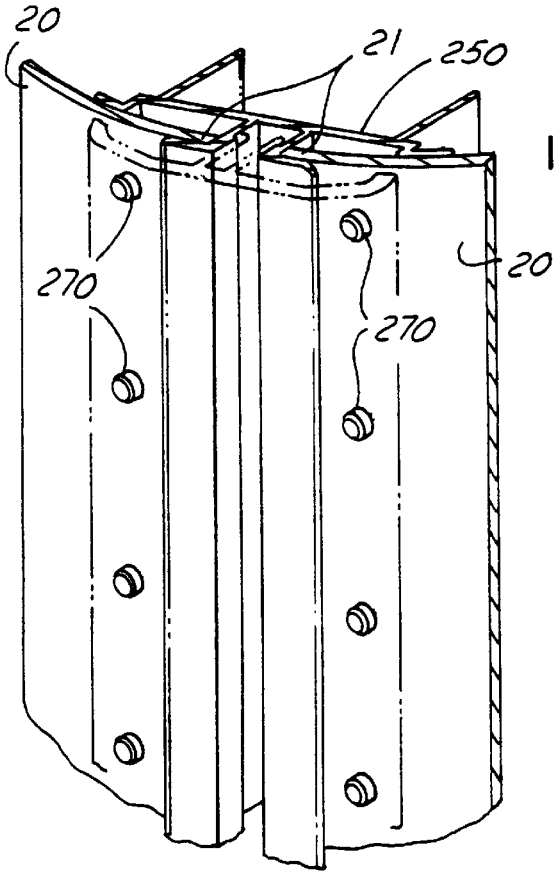

FIGS. 14 and 15 illustrate an alternate embodiment of the invention which utilizes dowel pins, rather than retainer clip members, tab members or the like, to attach and secure the panel members to the frame members. This embodiment improves the high wind performance of the round cladding system. In this embodiment, the frame member 250 depicted in FIGS. 14–15 is substantially the same as frame member 80 discussed above and shown in FIG. 7. The frame member 250 has a central elongated slot or channel 252 and two side channels 254 and 256. The trim cap member 260 has a wider profile than trim cap member 84 (FIG. 7) and is tightly snapped in channel 252. Pairs of mating ridge members 262 and 264 are provided on the frame member and cap member, respectively, in order to securely retain the cap member 260 in position.

A plurality of dowel pins 270 are used to hold the panel members 20 tightly in position on the frame member 250. The dowel pins are position in holes or openings adjacent to or along the edges 21 of, the panel members 20. The pins 270 are securely attached or connected to the panel members in any conventional manner. Also, other equivalent pins, rivets or posts could be utilized, such as pop rivets or the like in place of the dowel pins 270.

The pins 270 are trapped and secured in the channels 254 and 256 in the frame member 250 under the trim cap member 260. Some slight movement of the ends of the panel members and dowel pins in the channels is permissible and does not detract from the purposes or benefits of the present invention.

The use of the present invention to enhance the appearance of fuel (gasoline) pumps and other utility structures is depicted in FIGS. 16–19. A conventional gasoline pump structure 12 is shown in FIG. 16. The pump has a generally rectangular vertically upright structure 280, a pair of upright side members 282 and a horizontally oriented header member 284 which connects together the upper ends of the side members. A plurality of openings or wells 290 are provided—preferably on both sides of the pump 12—for holding the gasoline nozzles used to transport gasoline into the fuel tanks of the vehicles.

Panel members 300 are provided on both sides of the fuel pump 12. The panel members are preferably made of the same material as panels 20 discussed above, are initially provided and shipped in flat or planar conditions, and are bent into the curved or rounded positions shown in the drawings. The panel members 300 provide rounded "bullnose" sides or ends on the fuel pumps significantly increasing their aesthetic appearance.

Figure 17:
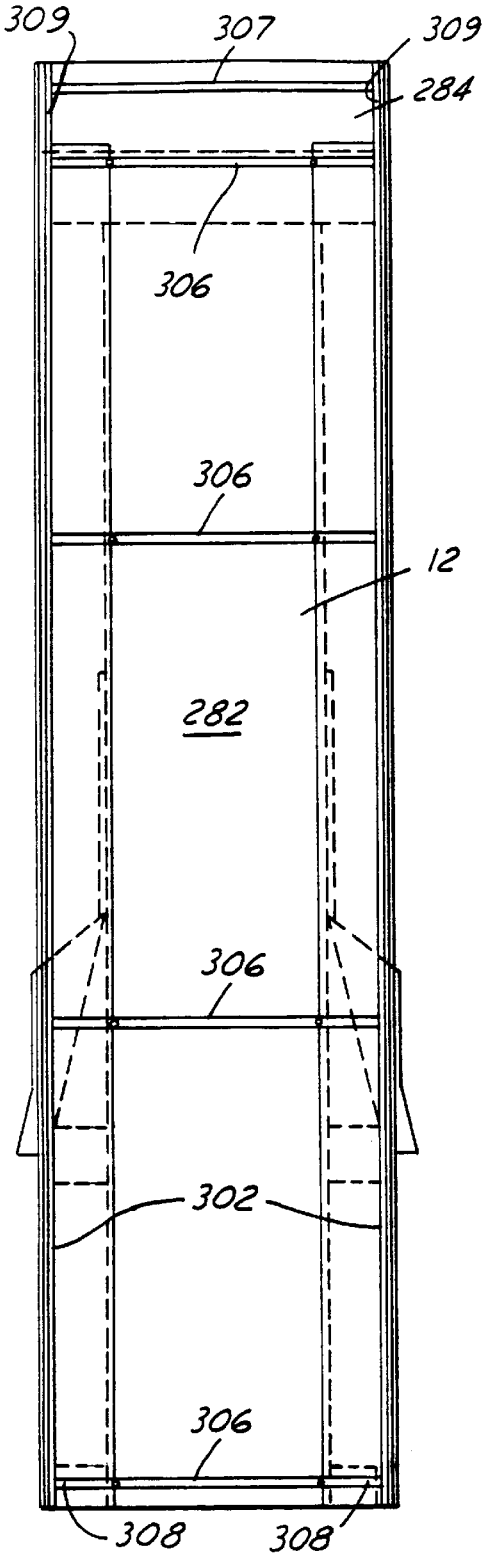
Figure 18:
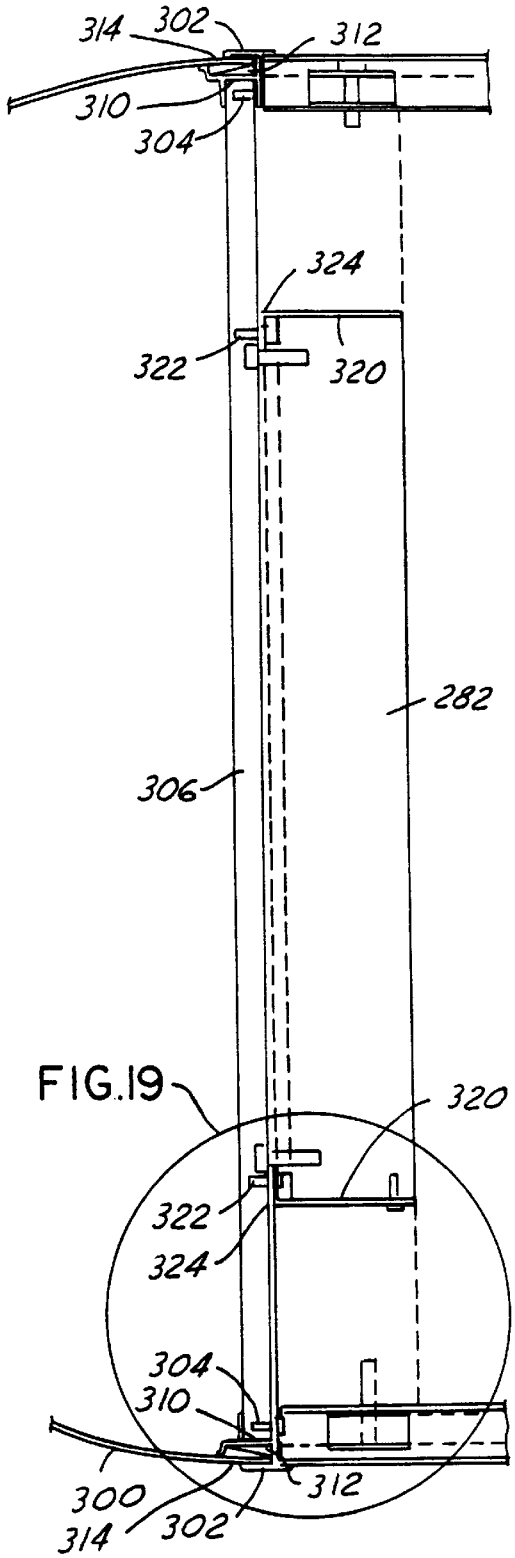
Figure 19:
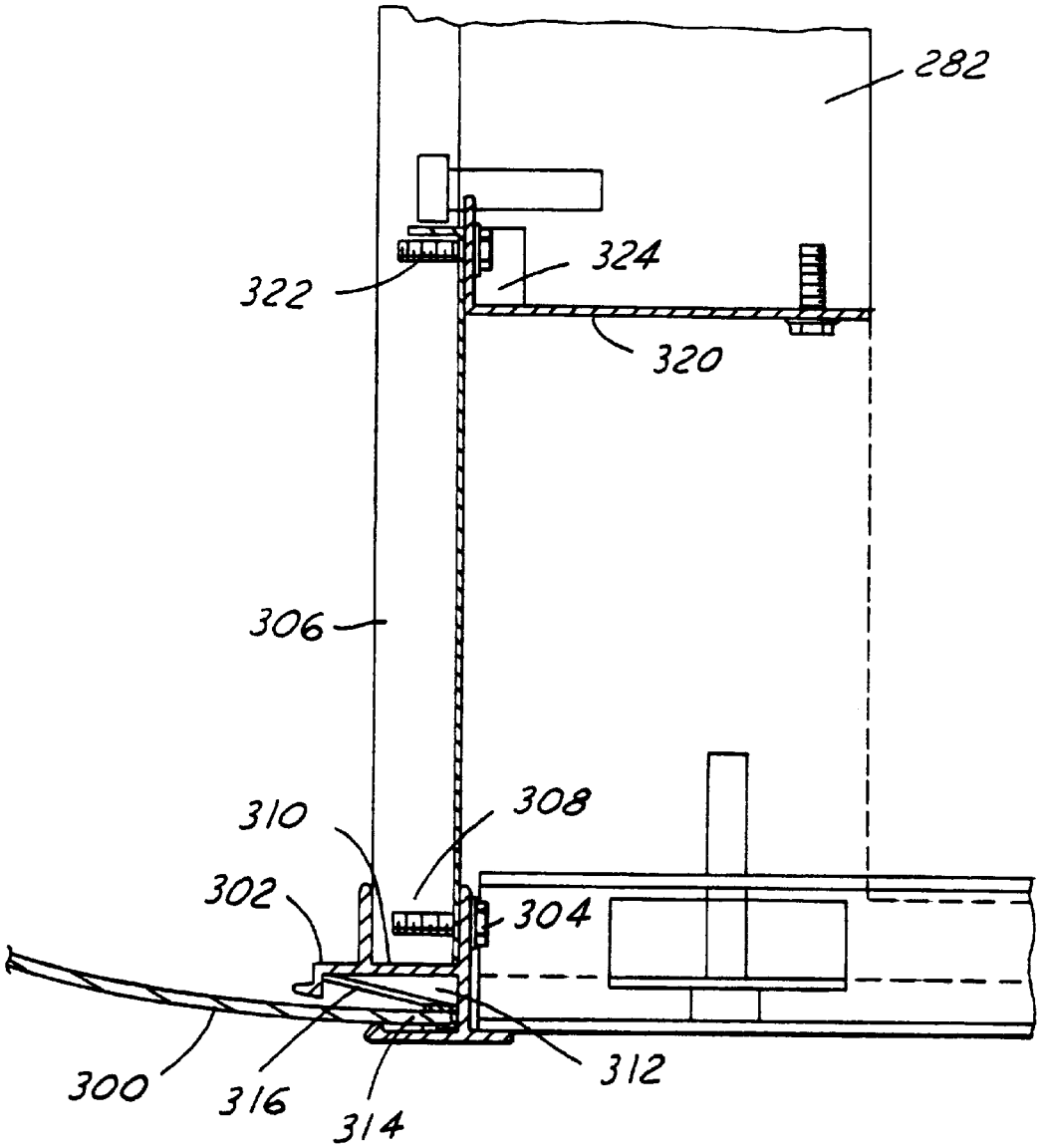

The side edges of the panel member 300 are positioned in frame members 302 (see FIGS. 17–19). The frame members 302 are elongated vertically oriented members made from an extruded material (preferably aluminum). The frame members are secured, as by fasteners 304, to the side members 282 of the fuel pump 12. A plurality of horizontally disposal mounting brackets 306 are also positioned along and secured to the exterior of the side members 282. A cross-brace bracket member 307 is positioned adjacent the header member 284. Ends 308 and 309 of the brackets 306 and 307, respectively, are positioned in channels 310 in the frame members 302.

The frame members 302 also have elongated channels 312 in which the edges 314 of the panel members 300 are positioned (This is similar to the manner in which the edges of the panel members are positioned and held in place in the frame members on the columns and posts, as discussed above). As shown in FIG. 19, clip members 316 (metal or plastic) can be utilized to hold the edges 314 of the panel members 300 securely in position in the channels 312. Alternatively, the edges of the panel members can be attached to the frame members by the use of tab members, dowel pins, or the like, as discussed above with reference to FIGS. 9 and 14–15.

If needed according to the particular fuel pump involved or its covering panel system, other mounting mechanisms, such as mounting strap 320, could also be utilized to assist in securing the inventive cladding system to the fuel pump. In the embodiment depicted in FIGS. 16–19, the mounting strap is shown fastened to the mounting brackets 306 by fasteners 322. For vibration, moisture and dust prevention, foam sealing members 324 also can be utilized.

Similar to the panel members 20 discussed above, the panel members 300 are preferably made and transferred to the installation sites in a flat or planar manner. Once at the site, the mounting brackets and vertical frame members are first installed and positioned on the sides of the fuel pumps, the tab, clip or pin members are positioned along the edges of the panel member, and the panel members are the manually formed into a semi-circular shapes and installed into position. (It is also possible to install the clip, tab or pin members on the panel members prior to being shipped to the assembly site).

Also, although the present invention has been described with respect to its usage on gasoline and fuel pumps at service stations, it is also to be understood that the round cladding system can be utilized with any type of utility or other structure and at any type of commercial or other establishment. Regardless of the structure, wherever the cladding system of the present invention is utilized, it will provide an attractive, pleasing appearance and enhance the appearance of the structure.

While the best modes for carrying out the invention have been described in detail, those familiar with the art to which this invention relates will recognize various alternative designs and embodiments for practicing the invention as defined by the following claims.

What is claimed is:

1. A cladding mechanism for a column, said column having a lower end adjacent the ground and an upper end adjacent a ceiling, said cladding mechanism comprising:

at least one support bracket mechanism for attachment to said column;

a pair of vertically-oriented elongated frame members attached to said support bracket mechanism, said frame members each having at least one channel member;

a plurality of panel members adapted to be positioned around said column, said panel members attached to said frame members; and a plurality of pin members attached along the edges of said panel members to assist in securing said panel members to said frame members, said pin members being positioned in said channel members.

2. The cladding system of claim 1 further comprising a trim cap member attached to each of said frame members.

3. The Cladding system of claim 1, further comprising at least one top cap member, said cap member being slidingly attached to an upper end of at least one of the panel members, wherein the upper end of the at least one panel member is adapted to be located adjacent the ceiling.

4. The cladding mechanism as set forth in claim 1 wherein said pin members comprise dowel pin members.

5. The cladding mechanism as set forth in claim 1 wherein said pin members are positioned along the edges of said panel members and protrude therethrough.

6. The cladding mechanism as set forth in claim 1 wherein at least two support bracket mechanisms are provided, and said frame members are attached to both of said bracket mechanisms.

7. The cladding mechanism as set forth in claim 1 wherein each of said frame members has two channel members and wherein said pin members are attached along two opposed edges of said panel member.

8. The cladding mechanism as set forth in claim 1 further comprising at least one joint back-up panel member positioned between adjacent panel members.

9. A cladding mechanism for a column, said column having a lower end adjacent the ground and an upper end adjacent a ceiling, said cladding mechanism comprising;

at least one support bracket mechanism for attachment to said column;

a pair of vertically-oriented elongate frame members attached to said support bracket mechanism;

a plurality of panel members adapted to be positioned around said column and attached to said frame members;

a plurality of pin members attached to said panel members to assist in securing said panel members to said frame members; and at least one top cap member, said cap member being slidingly attached to at least one of said frame members adjacent an upper end of the panel members, wherein the upper end of the panel members are adapted to be located adjacent the upper end of the column.

10. The cladding system of claim 9 further comprising a trim cap member attached to each of said frame members.

11. The cladding system of claim 9 wherein said frame members each have at least one channel member, and wherein said pin members are positioned in said channel members.

12. The cladding system of claim 9 wherein said pin members comprise dowel pin members.

13. The cladding system of claim 9 wherein said pin members are positioned along the edges of said panel members and protrude therethrough.

14. The cladding mechanism of claim 9 wherein at least two support bracket mechanisms are provided and said frame members are attached to both of said bracket mechanisms.

15. The cladding mechanism as set forth in claim 9 wherein each of said frame members has two channel members and wherein said pin members are attached along two opposed edges of said panel member.

16. The cladding mechanism as set forth in claim 9 further comprising at least one joint back-up panel member positioned between adjacent panel members.

17. A cladding mechanism for a column, said column having a lower end adjacent the ground and an upper end adjacent a ceiling, said cladding mechanism comprising:

at least two support bracket mechanisms for attachment to said column;

a pair of vertically-oriented elongated frame members, each of said frame members being attached to each of said support bracket mechanisms and each of said frame members having a pair of opposed channels therein;

a plurality of panel members adapted to be positioned around said column and attached to said frame members; and a plurality of dowel pin members attached to said panel members to assist in securing said panel members to said frame members, said dowel pin members being positioned in said channels.

18. The cladding system of claim 17 further comprising a trim cap member attached to each of said frame members.

19. The cladding system of claim 17 further comprising at least one top cap member, said cap member being slidingly attached to at least one of said frame members adjacent an upper end of the panel members, wherein the upper end of the panel members are adapted to be located adjacent the upper end of the column.

20. The cladding mechanism as set forth in claim 17 further comprising at least one joint back-up panel member positioned between adjacent panel members.

* * * * *